US005779049A

United States Patent [19]

Werby et al.

[11] Patent Number: 5,779,049

[45] Date of Patent: Jul. 14, 1998

[54] BIN LOADER PACKAGE AND METHOD

[75] Inventors: Robert W. Werby, Franklin, Va.; Peter F. Szeles, Strongsville, Ohio; A. Cameron Leslie, Chesapeake, Va.

[73] Assignee: Union Camp Corporation, Lawrenceville, N.J.

[21] Appl. No.: 597,949

[22] Filed: Feb. 7, 1996

[51] Int. Cl.[6] ..... B65D 85/62

[52] U.S. Cl. ..... 206/451; 206/449; 229/117.13; 229/122.2

[58] Field of Search ..... 206/449, 453, 206/497, 555, 45.22, 451, 215; 229/122.1, 122.2, 117.12–117.16, 3.5 R, 125.38, 183, 184

[56] References Cited

U.S. PATENT DOCUMENTS

| | | | |
|---|---|---|---|
| 1,144,803 | 6/1915 | Willets | 229/125.38 |
| 1,481,717 | 1/1924 | Lahey | 229/183 |
| 3,015,596 | 1/1962 | Couch et al. | 229/3.5 |
| 3,121,511 | 2/1964 | Whitehead | 229/122.2 |
| 3,184,138 | 5/1965 | Ridgeway, Jr. . | |
| 3,523,635 | 8/1970 | Croley et al. | 229/184 |
| 3,631,972 | 1/1972 | Gendron . | |
| 3,664,494 | 5/1972 | Mergens | 206/45.22 |
| 3,750,932 | 8/1973 | Ellison . | |
| 3,799,406 | 3/1974 | Goerke . | |
| 3,820,686 | 6/1974 | Tyrseck . | |
| 3,903,643 | 9/1975 | Blackmore et al. . | |
| 3,921,892 | 11/1975 | Macie . | |
| 4,005,777 | 2/1977 | Marantz | 206/497 |
| 4,210,273 | 7/1980 | Hegele . | |
| 4,397,406 | 8/1983 | Croley . | |
| 4,556,210 | 12/1985 | George . | |
| 4,770,301 | 9/1988 | Nagel . | |
| 4,802,586 | 2/1989 | George . | |
| 4,830,186 | 5/1989 | George et al. . | |
| 4,834,242 | 5/1989 | Selack et al. | 206/555 |
| 4,858,414 | 8/1989 | Meschi . | |
| 4,964,511 | 10/1990 | Meschi . | |
| 5,064,113 | 11/1991 | Hauber et al. . | |
| 5,251,819 | 10/1993 | McHugh . | |
| 5,261,595 | 11/1993 | Nanno et al. . | |
| 5,348,147 | 9/1994 | Gottfried . | |
| 5,429,294 | 7/1995 | Propst | 229/3.5 R |

*Primary Examiner*—Jimmy G. Foster
*Attorney, Agent, or Firm*—Dennis H. Lambert

[57] ABSTRACT

A bin loader package for shipping, storing and dispensing cut paper directly into the paper supply bin of equipment that uses the paper. The bin loader package comprises a box having opposite side walls, opposite end walls, a top and a bottom. The bottom includes foldable flaps that are foldable inwardly at least partially over the bottom of the box for supporting at least a marginal edge portion of sheets of paper placed in the box. The top includes foldable flaps that are foldable over the top of the box to close the top of the box, and the top wall flaps include structure to facilitate grasping of the top wall flaps to lift the box when it is desired to discharge the paper therefrom. The bottom wall flaps are unsecured to one another and are openable under the weight of paper in the box when the box is lifted, to enable the paper to drop through the open bottom for deposit onto a supporting surface, whereby the paper may be directly deposited from the box into a paper supply bin by simply lifting the box away from the paper. In one form of the invention, the bottom flaps are relatively narrow and do not close the bottom of the box. In another form of the invention, the bottom panels are dimensioned to close the bottom of the box when they are folded to their closed position. The Box may be treated to incorporate a moisture vapor barrier therein.

32 Claims, 11 Drawing Sheets

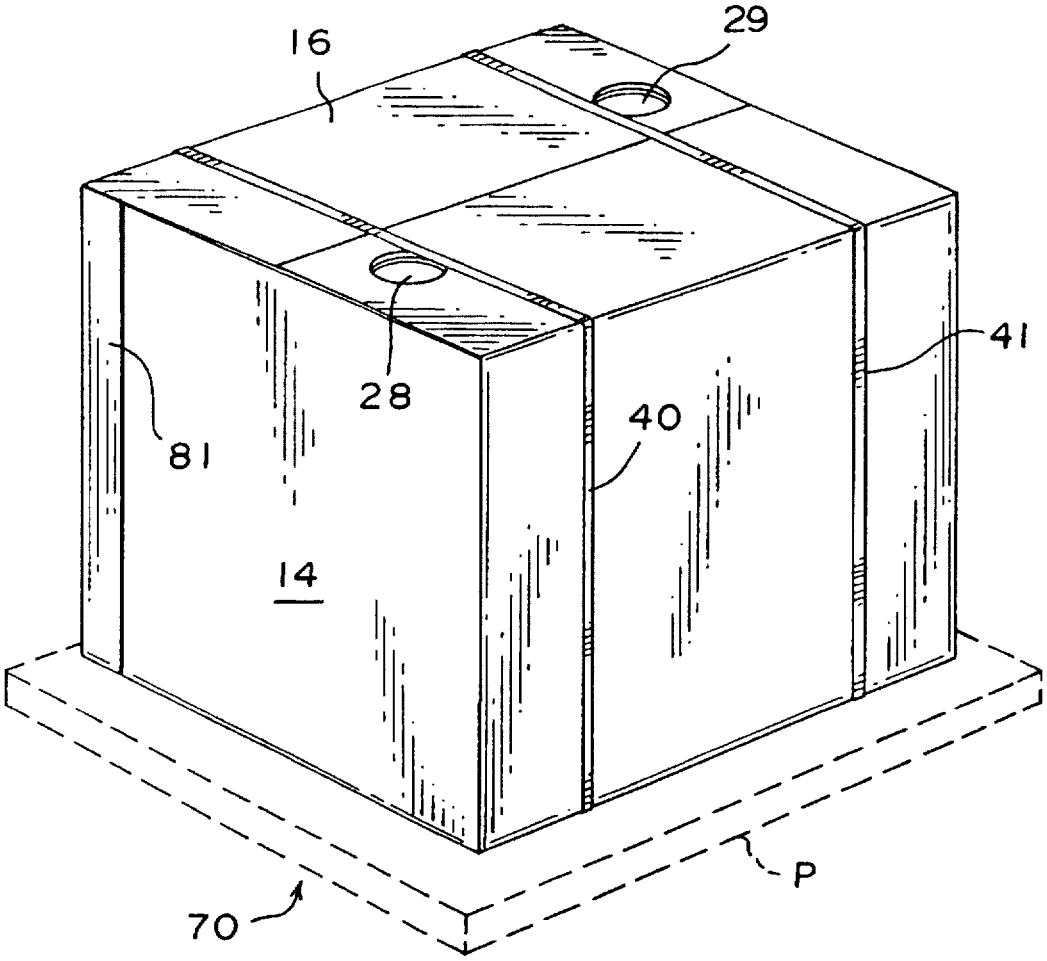
FIG. 19
FIG. 20
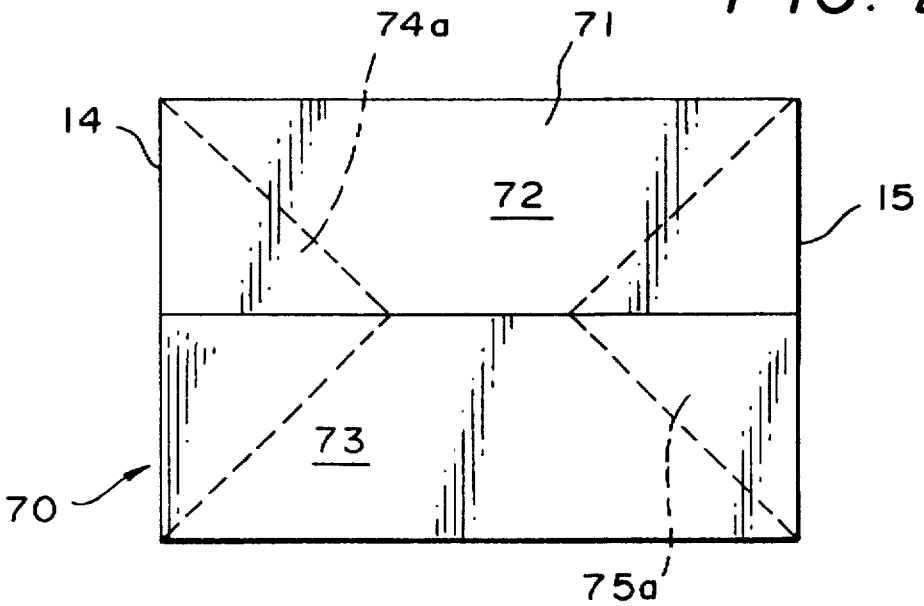

BIN LOADER PACKAGE AND METHOD

FIELD OF THE INVENTION

This invention relates to packaging, and more particularly, to a package and method for rapidly loading cut paper into the bin of a photocopier, printer, or similar machine. The invention is especially adapted for rapidly loading large quantities of cut paper into the bin of high-speed photocopying machines, printers, and the like which typically use large quantities of paper over short periods of time.

BACKGROUND OF THE INVENTION

Photocopiers, printers and like equipment are in widespread use in commercial and office environments. Such equipment generally has a compartment or bin in which a stack of sheets of paper is placed for use by the machine during its operation.

The paper for use in such machines has generally been packaged in individual reams covered with a ream wrap material to assist in maintaining the proper condition of the paper, and the wrapped reams are then placed in a cardboard or similar box for shipment and storage. When the need arises for loading paper into a photocopier, printer or the like, a box is opened and one or more reams of paper are removed from the box, the ream wrap removed, and the paper placed in the bin or other compartment of the machine for supplying paper to the machine during its operation.

This manner of packaging paper for use in such machines has not posed a problem for relatively low volume, low speed machines, since such machines typically hold only one or two reams or even less paper, and use it relatively slowly. However, relatively high speed, high volume photocopiers, printers and similar machines have come into more widespread usage, and these machines generally have relatively large paper holding capacities in order to provide an adequate supply for the greater rate of use due to their higher speed of operation. In spite of the large paper holding capacity of such machines it may be necessary to frequently replenish the supply of paper in the bin. With conventional packaging, it can take considerable time to open the box and then remove and open individual reams of paper so that the paper can be stacked one ream at a time in the supply bin of the machine, which may typically hold five or more reams of paper.

Efforts have been made to solve this problem, as exemplified by U.S. Pat. Nos. 4,556,210, 4,770,301, 4,802,586 and 4,830,186. These patents disclose various packaging concepts for loading large quantities of paper into the supply bin of a photocopy machine without the necessity of opening individual reams of paper. In these patents, the carton or package in which the paper is supplied is placed on the elevator platform of the supply bin in the photocopier or other machine and the carton is then manipulated so that it can be removed from the bin, leaving the paper stacked on the platform. All of these patents (except U.S. Pat. No. 4,830,186) involve fairly complex box constructions, and require lateral movement of box components away from the bin of the machine. In other words, the packages described in these patents are essentially side discharge packages. Moreover, the complexity of their construction adds substantially to the cost of the package and the difficultly of use. Thus, while the prior art packages enable a large quantity of paper to be stacked in the supply bin of a photocopier or similar machine without requiring individual reams of paper to be opened, the prior art devices require substantial manipulation of the package itself, thereby at least partially offsetting the advantages gained by eliminating he need to open and handle individual reams of paper.

Accordingly, there is need for a simple and inexpensive package which enables a large quantity of paper to be quickly and easily supplied to the paper supply bin of a photocopier or printer or other machine, without the necessity of handling individual reams of paper.

SUMMARY OF THE INVENTION

The present invention provides an exceptionally simple and economical package for shipping, storing and dispensing paper into the paper supply bin of photocopiers, printers and the like.

The basic concept of the invention is to provide a single stack of loose sheets of paper in a box sized roughly for the capacity of the supply bin of a photocopier, printer, or similar machine. The box includes an unsecured bottom wall that is supported during shipping and handling by temporary support means applied to the box. When it is desired to transfer the paper from the box to the supply bin of a photocopier or the like, the package is set in the bin and the temporary supports removed, after which the box is simply lifted out of the bin, with the unsecured bottom opening to deposit the paper onto the elevator platform of the bin of the machine. The unsecured bottom comprises inwardly folded flaps on the bottom edges of the side and end walls of the box, with the paper being supported on these flaps prior to lifting of the box to discharge the paper from it.

In a preferred form of the invention, the flaps forming the bottom wall are relatively narrow so that they support the paper only at a peripheral margin thereof. In this form of the invention, when the box is lifted to deposit the paper onto the platform of the supply bin of the photocopier or other machine, the paper drops only a very short distance as the flaps are moved to their unfolded or open position by the weight of paper contained in the box. In order to protect the paper during shipping and handling and to prevent premature discharge of the paper from the package, shrink wrap is applied to the box and at least one support strap is placed around the box to hold the flaps closed and to keep the paper in place in the box.

In another form of the invention, a false bottom or panel is placed in the bottom of the box and is supported on the inwardly folded narrow marginal flaps, with the paper being supported, in turn, on this panel. In use, the temporary supports are removed from the box and when the box is lifted the narrow flaps unfold or open up and the bottom panel and paper supported thereon are deposited on the platform of the supply bin of the machine. This panel may then be slid out from under the paper, if desired. Further, in this form of the invention the box and false bottom or panel may be treated with a moisture vapor barrier material to maintain proper moisture content in the paper stored within the box. In this embodiment, a shrink wrap or other means of maintaining proper moisture content in the paper, such as ream wrap on individual reams of paper, is not necessary.

In another form of the invention disclosed herein, the flaps forming the unsecured bottom are relatively wide and essentially close the bottom of the box when they are folded to their closed position. Since the bottom of the box in this form of the invention is completely closed by the flaps, there is no need for a false bottom or interior panel. The box may be treated with a moisture vapor barrier material, or other means may be provided to maintain proper moisture content in the paper stored within the box.

In all forms of the invention, dispensing of the paper into the supply bin of a photocopier or other machine is easily accomplished simply by lifting the package into the supply bin, removing the temporary supports which maintain the package closed, and then lifting the carton or box out of the bin, depositing the paper onto the platform of the bin.

The box of the invention may be made of any suitable material, including cardboard, paperboard, plastic, or other material, as desired. Moreover, the package of the invention may be made in any desirable size for holding an appropriate quantity of paper to fill the bin capacities on various photocopiers, printers and other machines that may be used. It is contemplated, however, that the paper capacity of the package according to the invention will range from about 1,500 sheets up to about 2,500 sheets.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 19 is a top perspective view of a fourth form of the invention, wherein a full bottom closure is provided in the box;

FIG. 20 is bottom plan view of the package of FIG. 19, illustrating the larger flaps on bottom of the box, which extend across the bottom of the box to fully close it;

FIG. 23 is an end view of the box of FIG. 22, with portions broken away, illustrating the relative positions of the bottom flaps during their movement to an open position as the box is being lifted to deposit the stack of paper onto the platform of the supply bin in a photocopier or the like;

FIG. 24 is a fragmentary end view in elevation of the package of FIGS. 19–23, showing how the bottom is unfolded as the box is lifted to deposit the stack of paper onto the platform of the supply bin of the photocopier or the like;

FIG. 25 is an exploded perspective view of the package of FIGS. 19–24, showing the box fully removed to deposit the stack of paper onto the platform of the photocopier or the like.

DETAILED DESCRIPTION OF THE PREFERRED EMBODIMENTS

Figure 1:
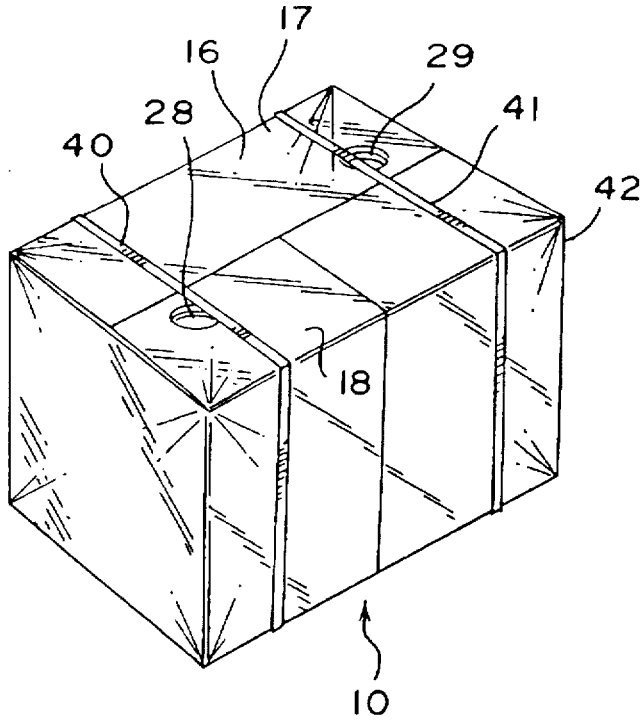
FIG. 1 is a top perspective view of a first form of the bin loader package according to the invention, wherein the package is shrink-wrapped.

Referring more specifically to the drawings, a first form of bin loader package according to the invention is indicated generally at 10 in FIGS. 1–9. The package according to this form of the invention comprises a rectangularly shaped box 11 having opposite side walls 12 and 13 and opposite end walls 14 and 15.

The upper end of the box is closed by a bellows-folded top wall 16 defined by flaps 17, 18, 19 and 20 integrally formed on the upper ends of the side and end walls, respectively. As seen best in FIGS. 3–5 and 7–9, bellows-folded end flap 19 is defined by a pair of diagonally extending fold lines 21 and 22 extending from the opposite corners of the upper end of the end wall 14 to approximately the center of the upper free edge of the flap 19, defining three triangularly shaped contiguous panels 19*a*, 19*b* and 19*c*.

Similarly, bellows-folded end panel 20 is defined by a pair of diagonally extending fold lines 23 and 24, defining three triangularly shaped contiguous panels 20*a*, 20*b* and 20*c*.

Figure 9:
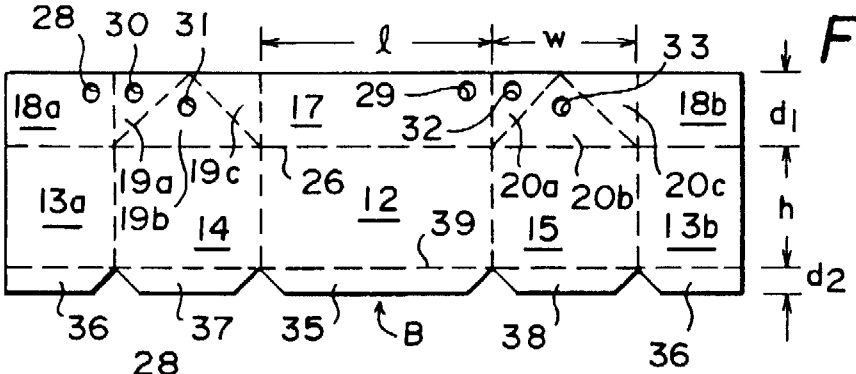
FIG. 9 is a plan view of the blank used in forming the carton or box of that form of the invention shown in FIGS. 1–8.
Figure 8:
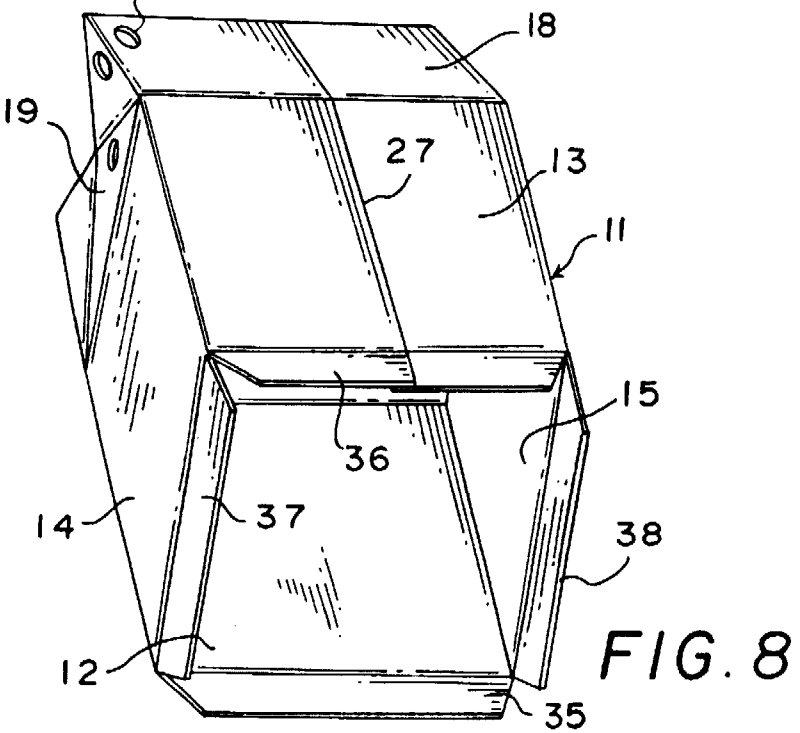
FIG. 8 is a bottom perspective view of the box of that form of the invention shown in FIG. 1, illustrating the flaps at the top and bottom of the box in their unfolded, open position.
Figure 11:
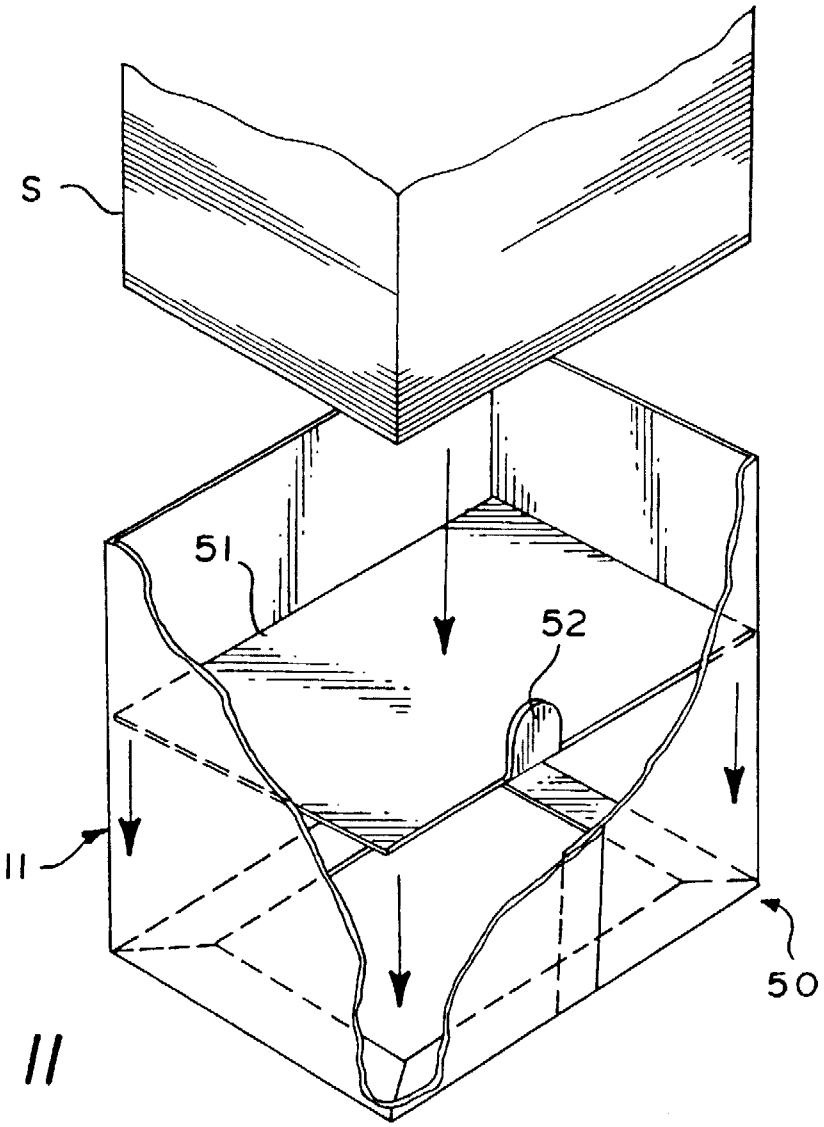
FIG. 11 is an exploded, fragmentary perspective view of the package of FIG. 10, with portions broken away, and showing the separate bottom panel that is placed in the box in overlying relationship to the flaps on the bottom of the box.
Figure 10:
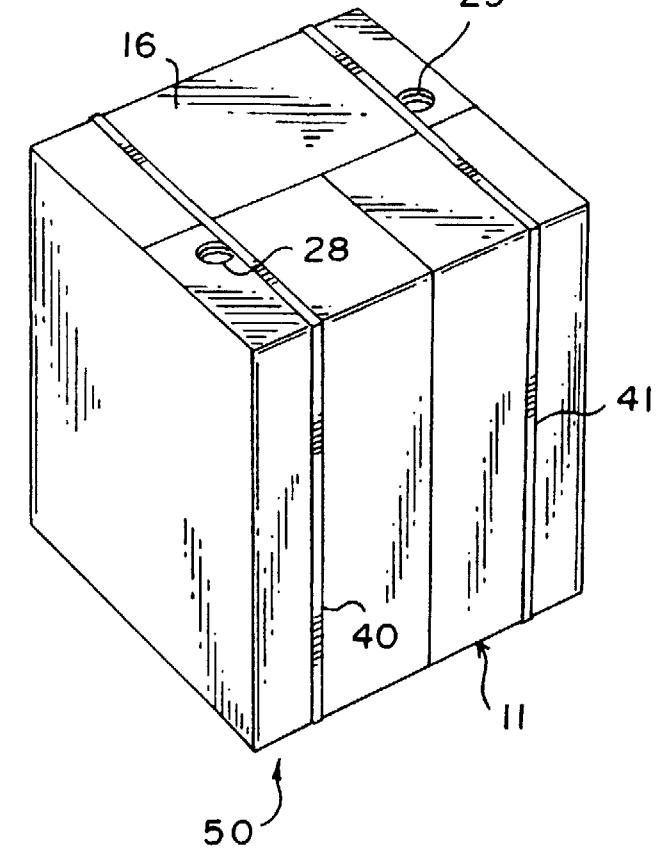
FIG. 10 is a top perspective view of a second form of the invention, wherein the shrink wrap is omitted and a bottom panel is placed in the box to protect and support the bottom sheets of paper.
Figure 12:
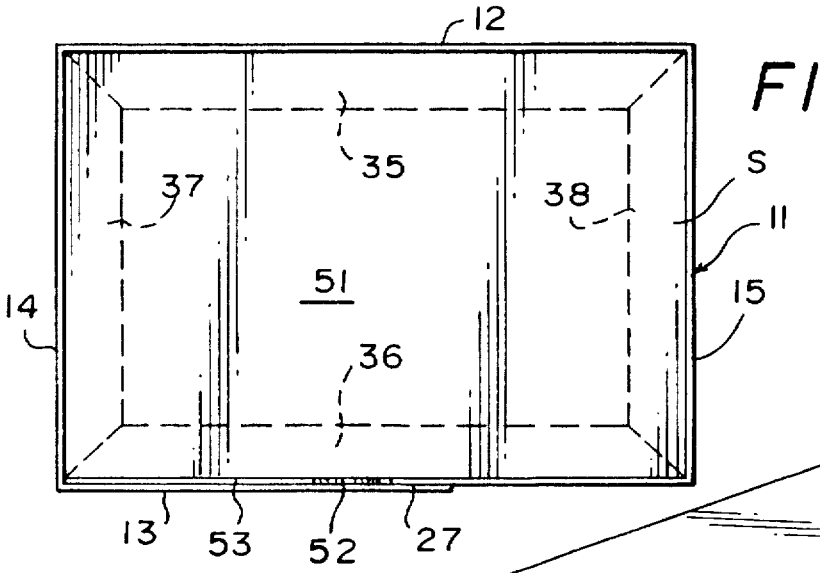
FIG. 12 is a top plan view of the package of FIG. 10, with the temporary support straps removed and the top flaps folded to a fully extended open position, and illustrating how the bottom panel fits in the box and the tab at one side of the panel is received in the space formed by the juncture between two side wall sections.

The panels 17, 18, 19, and 20 forming the bellows-folded top wall 16 are joined to the upper edges of the box side walls 12, 13, 14 and 15, respectively, along a fold line 26 extending the entire length of the blank B from which the box is made (see FIG. 9). The top wall panel flap 18 comprises two half panels 18*a* and 18*b* that are joined together at approximately their midpoint along a manufacturers seam 27 that joins the two ends of the blank together in the erected box and comprises the only glue joint in the box. Similarly, and with reference to FIG. 9, it will be observed that the side wall 13 also comprises two half panels 13*a* and 13*b* that are joined along the manufacturers seam 27 to form the side wall 13 in the erected box.

With further reference to FIG. 9, it will be noted that the panels 17–20 which form the top wall 16 extend upwardly beyond the fold line 26 a distance "$d_1$" that is approximately one half as great as the width "w" of the end panels 14 and 15. Thus, when the panels forming the top wall are folded inwardly over the upper end of the box, the free edges of opposite side panels 17 and 18 come into close proximity or contiguous relationship with one another, effectively closing the upper end of the box. See FIG. 1.

A plurality of holes or openings are formed at predetermined locations in the panels that define the top wall 16, for a purpose to be described hereinafter. These holes or openings include an opening 28 adjacent the inner upper corner of half panel 18*a*, and a corresponding opening 29 adjacent the free upper edge of panel 17 near one end thereof. These openings are positioned such that in the erected box the openings 28 and 29 are disposed near opposite ends of the box, respectively, and on opposite sides of the longitudinal centerline thereof. See FIGS. 1 and 3.

A pair of openings are also formed in each top end flap 19 and 20, respectively, including an opening 30 in panel 19*a* and an opening 31 in panel 19*b*, as well as corresponding openings 32 and 33 in panels 20*a* and 20*b*, respectively.

The bottom of the box is defined by four relatively narrow marginal flaps or flanges 35, 36, 37 and 38, joined to the side wall panels along a fold line 39 which extends the entire length of the blank B forming the box (see FIG. 9).

As seen in FIG. 9, these bottom flaps extend beyond the fold line 39 a distance "$d_2$" that is substantially less than the distance "$d_1$" at the top flaps forming the top wall of the box.

Figure 2:
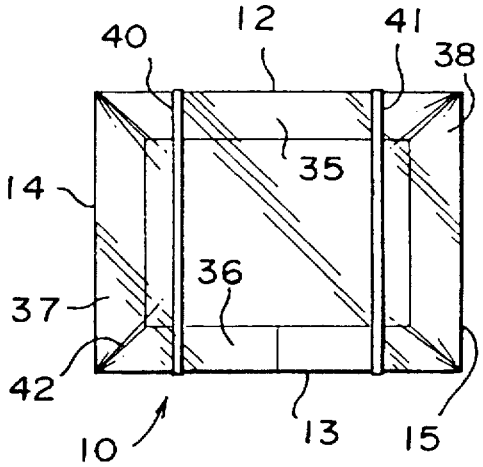
FIG. 2 is a bottom plan view of the package of FIG. 1.

Thus, and with reference to FIG. 2, it will be observed that the bottom flaps 35–38 extend inwardly over only a marginal edge portion of the bottom of the box.

Since the bottom of the box is not closed in this form of the invention, and does not include interlocking bottom panels to form a load bearing bottom wall, the package is held closed by one or more tie straps 40, 41 wrapped around the box in a lateral and/or longitudinal direction. As illustrated herein, one specific form of the invention includes a pair of tie straps 40 and 41 wrapped laterally around the box, spaced approximately equidistantly along its length. These tie straps serve to hold the bottom of the box closed and retain the sheets of paper "S" in the box until ready for use.

Because of the relatively large opening left in the bottom of the box in this form of the invention, a shrink wrap 42 is applied around the box to protect the paper therein from ambient conditions.

In use of this form of the invention, the package is prepared by placing a quantity of sheets of paper "S" in the box 11 and securing the box closed with one or more straps 40, 41, after which the box is shrink-wrapped with a suitable material to protect the paper from the environment. For example, a polyethylene film may be used to shrink wrap the box. The box may then be shipped and stored until it is ready for use. When it is desired to supply paper from the box to the bin of a photocopier or other machine, the shrink wrap 42 is removed and the box is carried to the machine. If desired, the box may be lifted by grasping the straps 40 and 41. Insertion of the fingers under the straps may be facilitated by the openings 28 and 29, which are disposed in at least partially underlying relationship to the straps 40 and 41.

Figure 3:
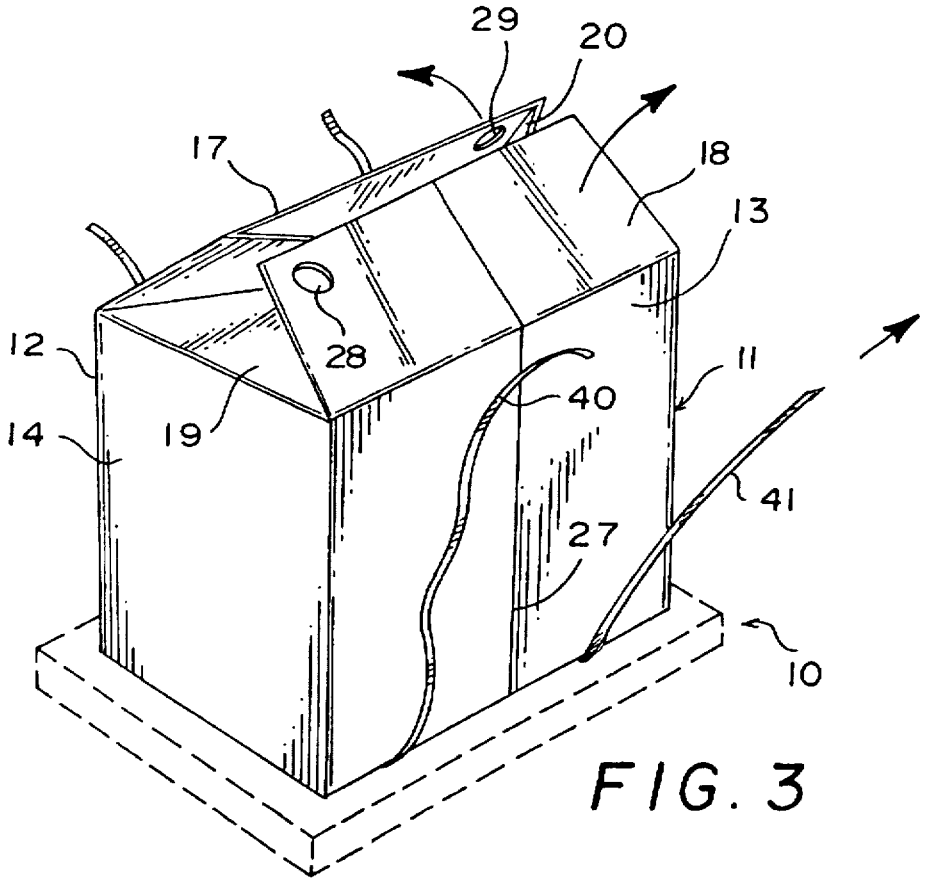
FIG. 3 is a top perspective view of the package of FIG. 1, with the shrink wrap removed and showing the package resting on the platform of the paper supply bin in a copier or the like, with the temporary support straps severed to enable removal of the straps and carton.
Figure 6:
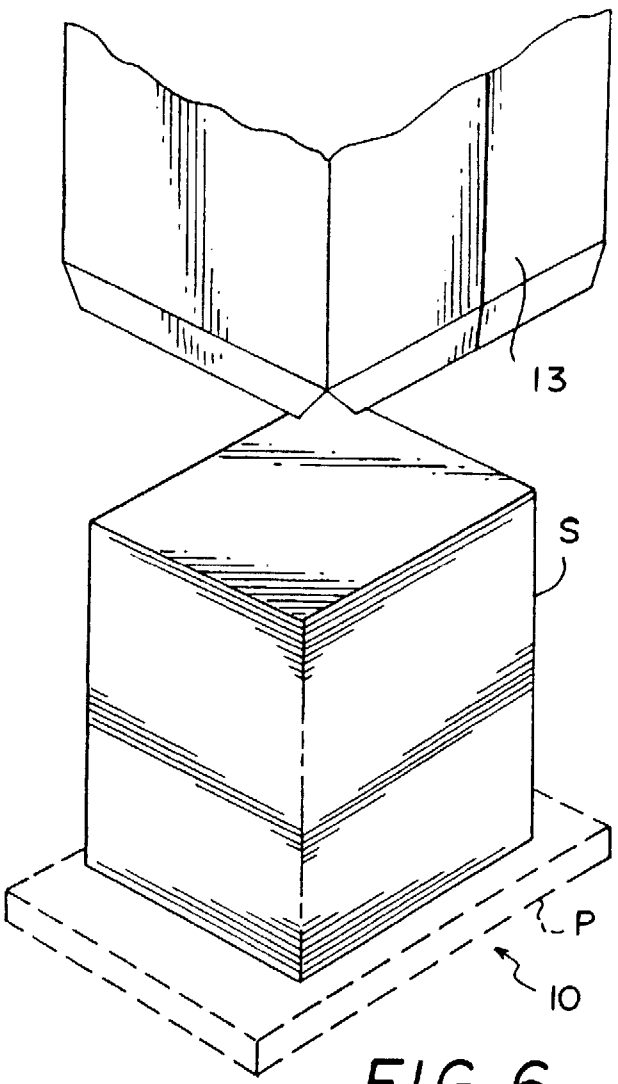
FIG. 6 is an exploded perspective view of the package of the invention, showing the carton removed and the paper deposited onto the platform of the supply bin of a photocopier or other machine.
Figure 5:
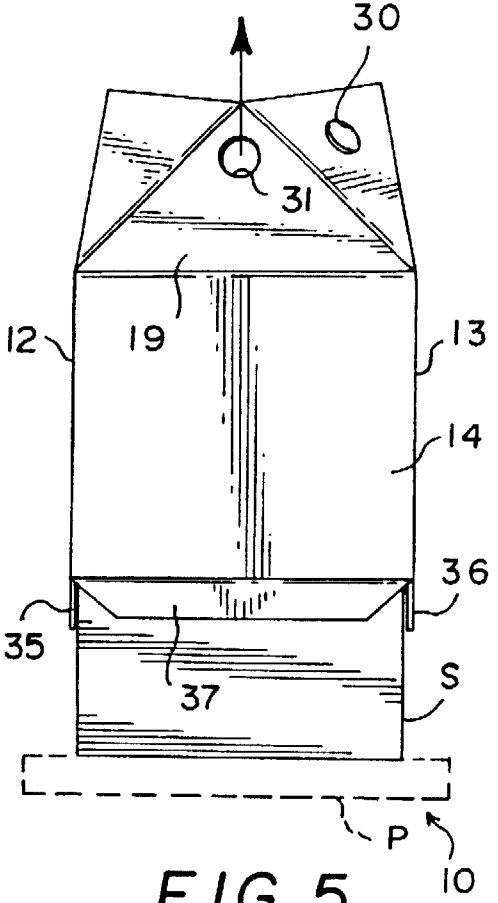
FIG. 5 is an end view in elevation of the package of FIG. 4.
Figure 4:
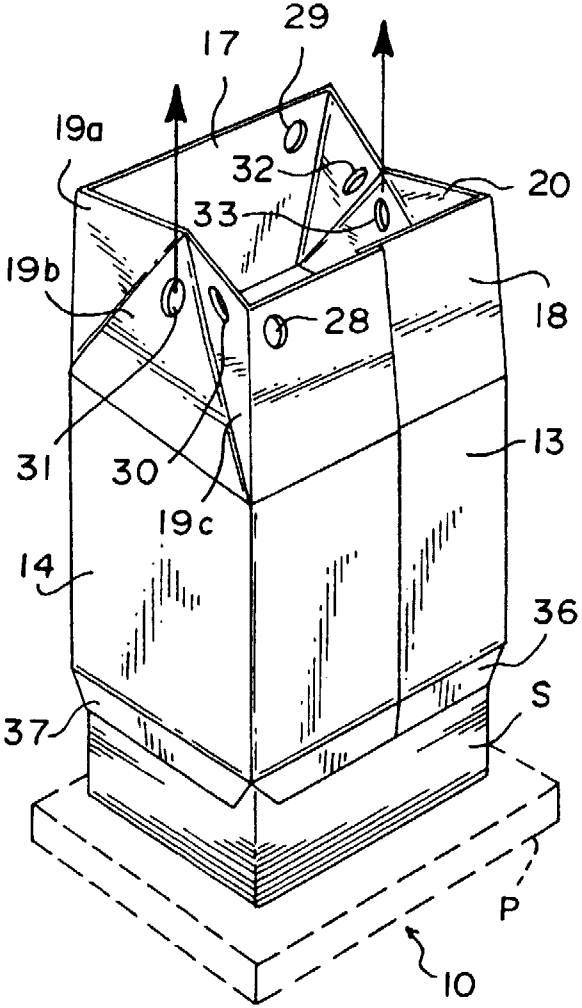
FIG. 4 is a top perspective view of the package of the invention, after the support straps have been removed, and showing the carton or box being withdrawn to deposit the paper on the platform of the photocopier or other machine.
Figure 7:
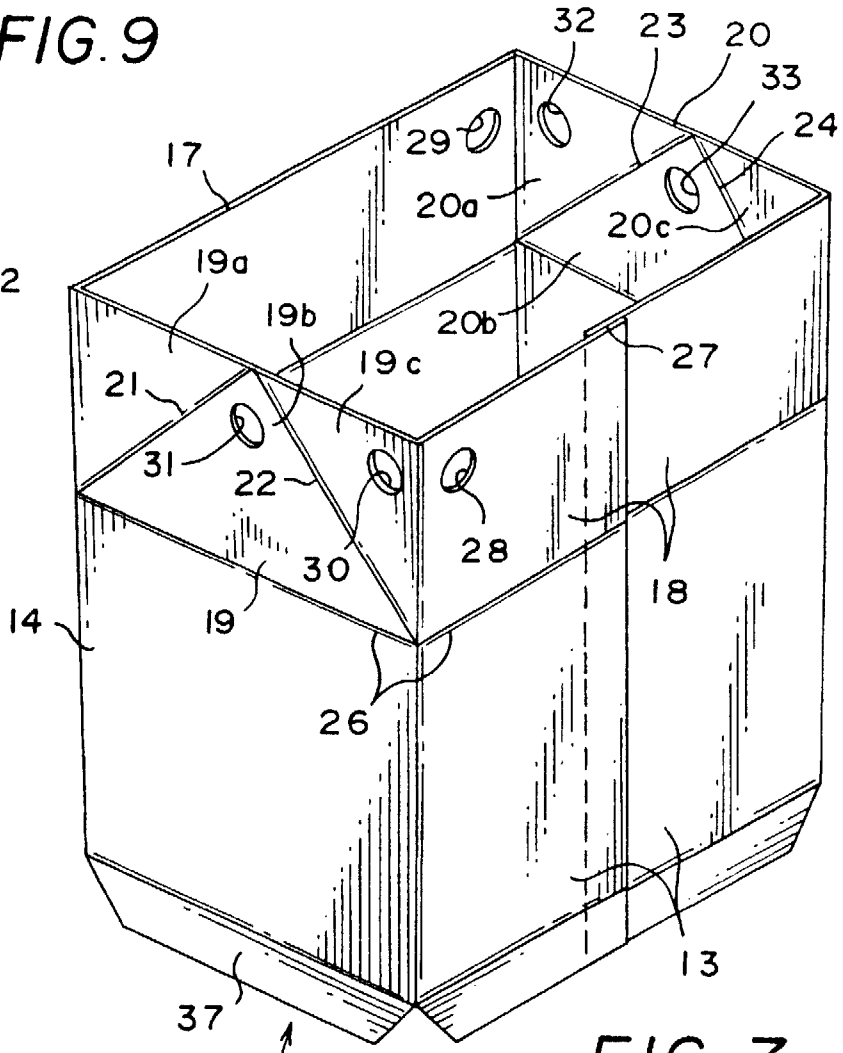
FIG. 7 is a top perspective view of the carton or box of that form of the invention shown in FIG. 1, illustrating the flaps at the top and bottom of the box in their unfolded, open position.

The box is lifted onto the elevator platform "P" in the paper supply bin of a photocopier or other machine, and the support straps 40 and 41 are cut and removed, as depicted in FIG. 3. The top wall panels 17 and 18 are then pivoted upwardly to an open position and the index and middle fingers of each hand may be inserted into the respective openings 30-31, 32-33 in the opposite top end wall panels 19 and 20, respectively, to lift the box from the stack of paper "S", depositing the paper onto the platform "P" as depicted in FIGS. 4, 5 and 6.

It will be seen that manipulation of the box of the invention is relatively simple, and a minimal number of steps and minimum effort are required to remove the box to deposit the entire contents thereof in the paper supply bin of a photocopier or other machine. The relatively narrow width of the bottom wall flaps 35–38 ensures that the box may be relatively easily removed, and the paper will drop only a short distance as the box is lifted away from the paper. For instance, in a preferred embodiment of the invention the bottom wall flaps 35–38 have a dimension "$d_2$" from the fold line 39 to their free edges of only one and one half inches, as compared with a width "$d_1$" of approximately 4 5/16 inches at the top wall flaps 17–20. The box may have any suitable height, width and length dimensions, h, w, and l, respectively, as suitable or desired for a particular quantity of paper or paper size to be packaged in the box.

The box may be made of a corrugated material, such as B, E or F-flute, for example, with Kraft paper liners having a basis-weight ranging from 33 pounds to 42 pounds, and 26 pound mediums. The burst strength of the box, in a preferred embodiment, may range from 150 pounds to 200 pounds, and the box may be sized for any capacity, e.g., 1500–2500 sheets. Further, the box may be provided with a suitable moisture vapor barrier, e.g., a laminated liner, a coated liner, a plastic wrap, or an insert at the top and/or bottom sheets. The moisture vapor barrier material may be any suitable material, including a film-forming emulsified material that forms a close-grained crystal structure which is hydrophobic upon curing. A repulpable coating with water vapor barrier properties may also be formed from available dispersions such as acrylates and the like. Further, the moisture barrier may comprise a layer of polyethylene extruded onto or otherwise applied to paper. A specific construction comprises a lamination of low density polyethylene (LDPE) and Kraft paper applied as the inner or outer lining of the box.

Although polyethylene forms an effective moisture barrier, it is not readily recyclable.

First Modification

A first modification of the invention is indicated generally at 50 in FIGS. 10–14. This form of the invention is substantially identical to that described in relation to FIGS. 1–9, except that a bottom wall panel 51 is provided in the bottom of the box 11 to close the opening left by the relatively narrow marginal bottom flaps 35–38. Bottom panel 51 has a small pull tab 52 formed on one edge thereof in a position to lie within the space 53 defined between the edge of the stack of paper "S" and the side wall 13 of the box caused by the overlapping manufacturers seam 27 in the side wall 13.

In all other respects, this form of the invention is identical to that previously described, and the same comments apply with respect to box dimensions and the manner of use, with the exception of the elimination of the use of shrink wrap and the use, instead, of a bottom panel to close the bottom of the box.

Figure 13:
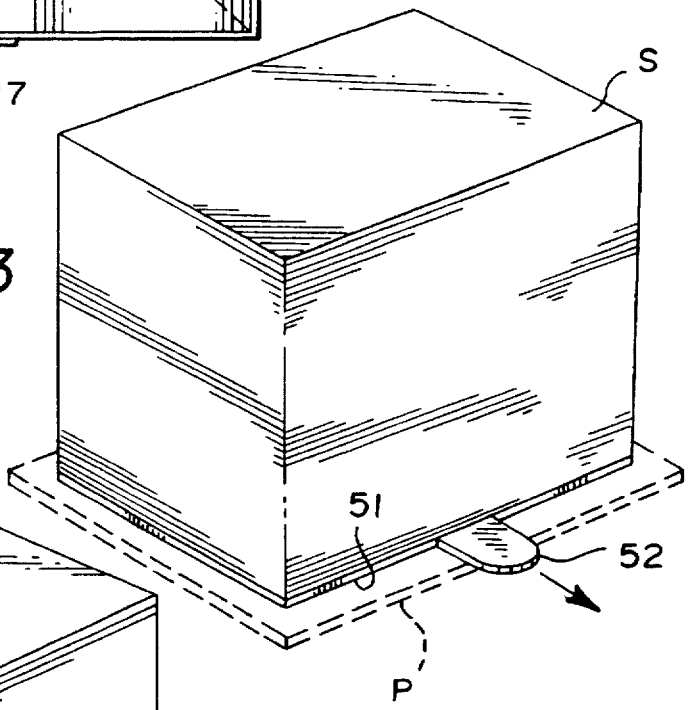
FIG. 13 is a top perspective view of a stack of paper and bottom panel as deposited by removal of the box in that form of the invention shown in FIG. 10, prior to removal of the bottom panel.
Figure 14:
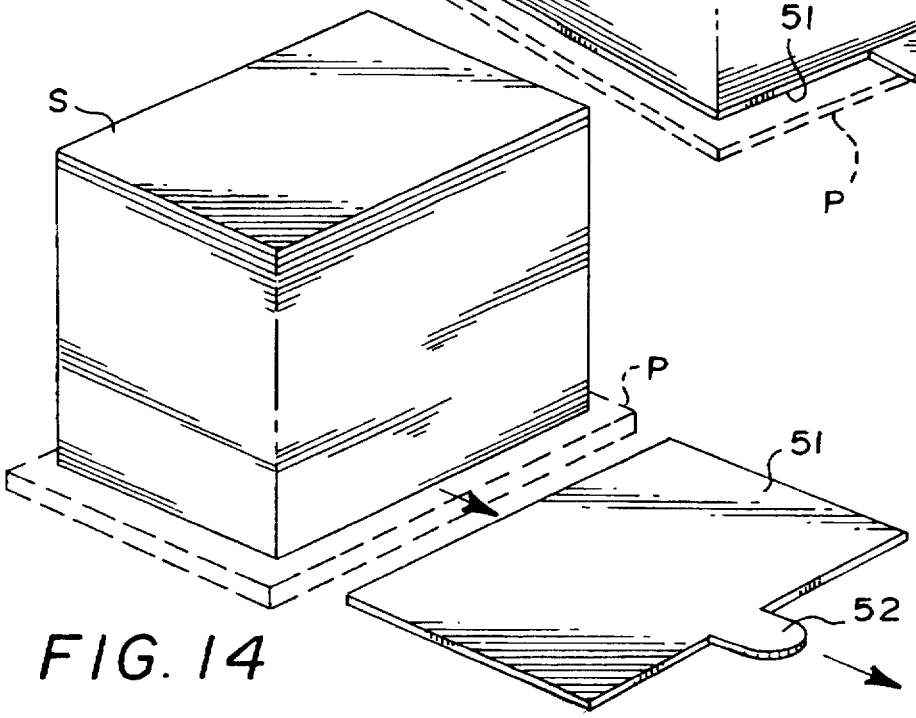
FIG. 14 is a top perspective view similar to FIG. 13, showing the bottom panel removed.
Figure 16:
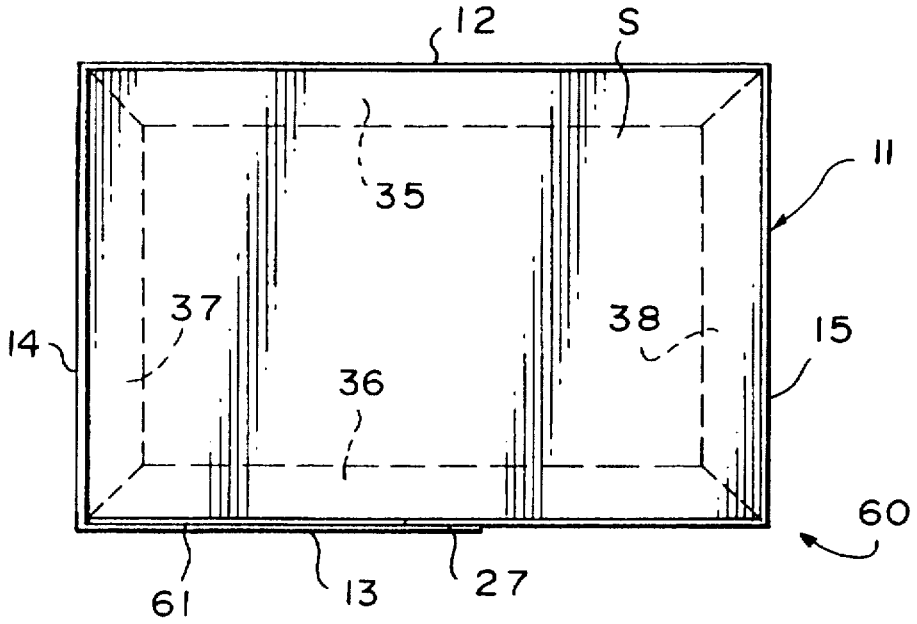
FIG. 16 is a top plan view similar to FIG. 12, showing the relationship of the bottom panel to the box and stack of paper in that form of the invention illustrated in FIG. 15.
Figure 15:
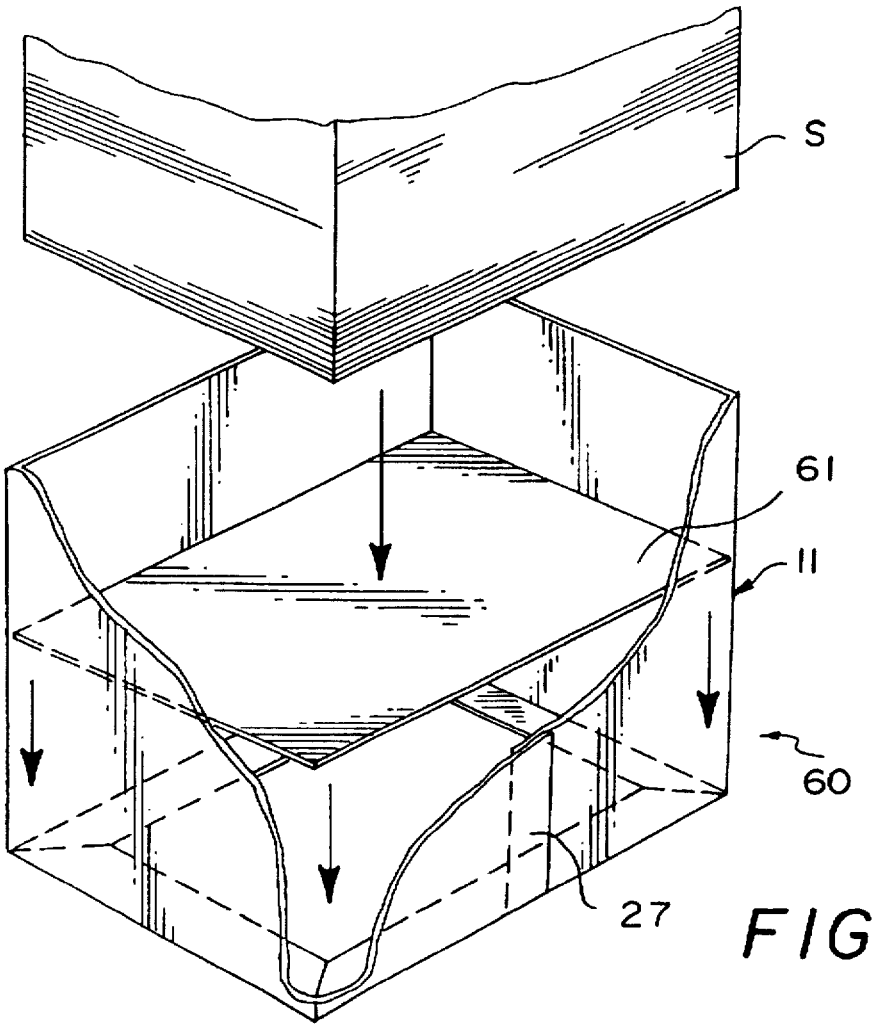
FIG. 15 is an exploded, fragmentary perspective view similar to FIG. 11 of a third form of the invention, wherein a bottom panel is placed in the box beneath the stack of paper received therein, and wherein the pull tab is omitted from the panel.
Figure 18:
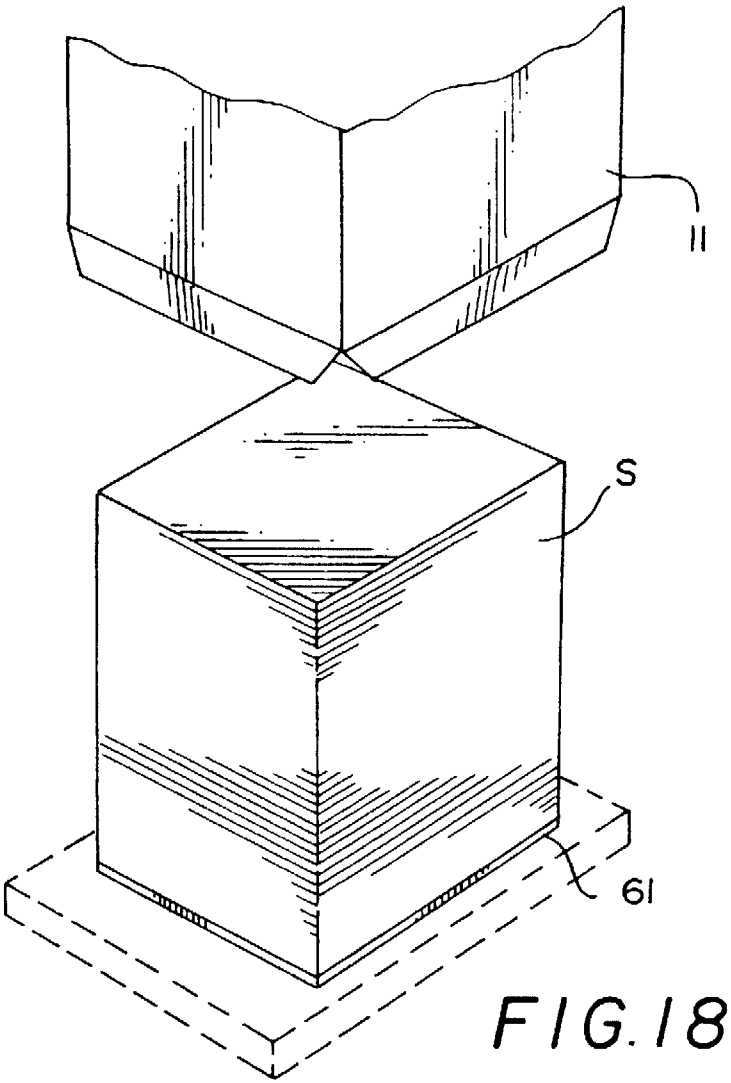
FIG. 18 is an exploded, fragmentary top perspective view of that form of the invention shown in FIGS. 15–17, and illustrating how the bottom panel is left in place beneath the stack of paper after the paper is deposited into the paper supply bin of the machine.
Figure 17:
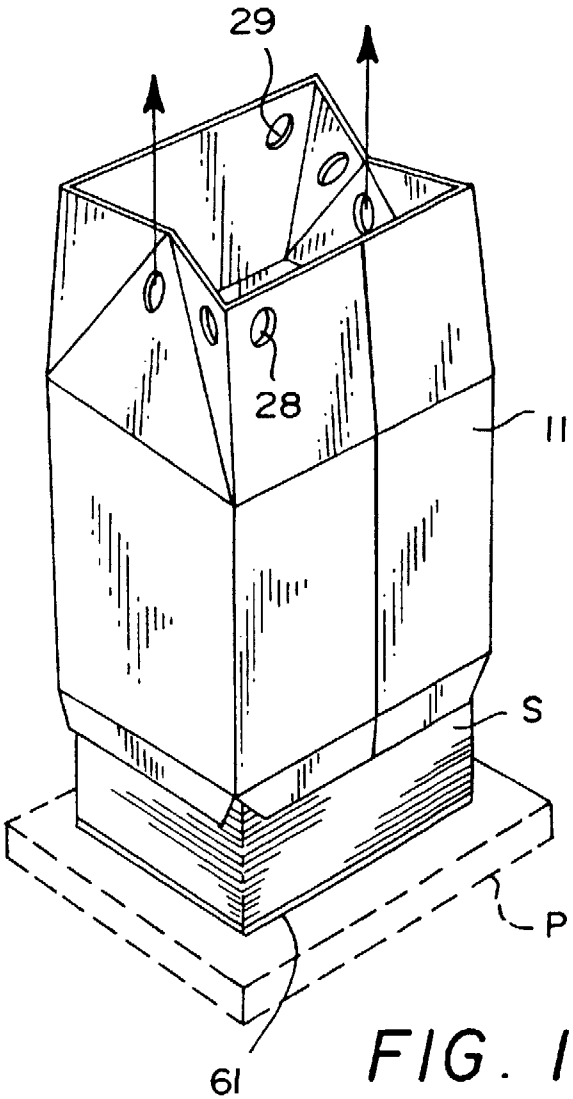
FIG. 17 is a top perspective view showing the box being withdrawn from the stack of paper to deposit the paper and the bottom panel on the platform of a photocopier or other machine.
Figure 21:
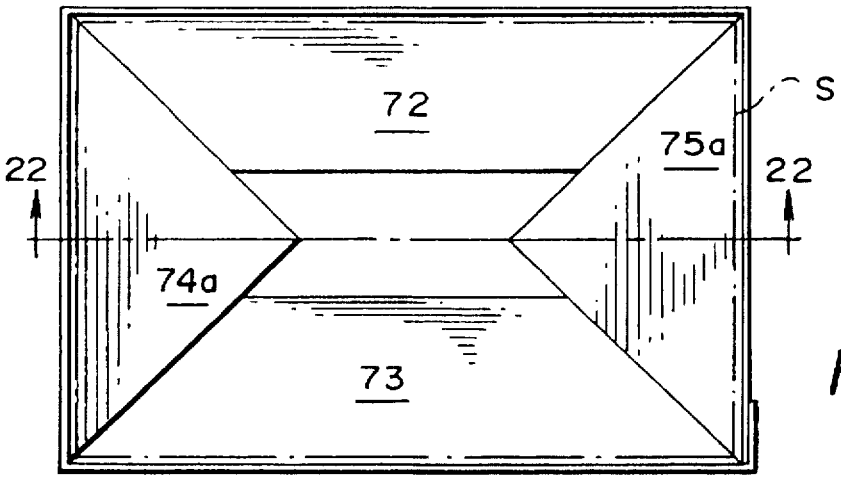
FIG. 21 is a somewhat schematic top plan view of the box of FIG. 19, showing the relationship of the bottom flaps in a partially unfolded condition, and depicting the stack of paper in dot-and-dash lines.
Figure 22:
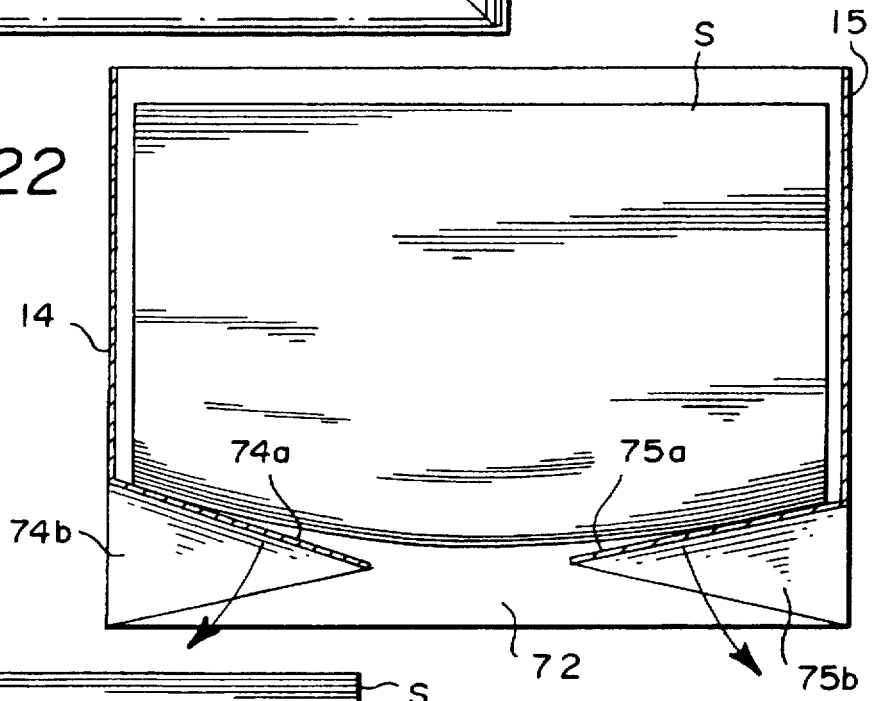
FIG. 22 is a longitudinal sectional view taken along line 22—22 in FIG. 21, showing the paper in full lines, and illustrating the relationship of the flaps during their movement from a fully closed to a fully opened position.
Figure 23:
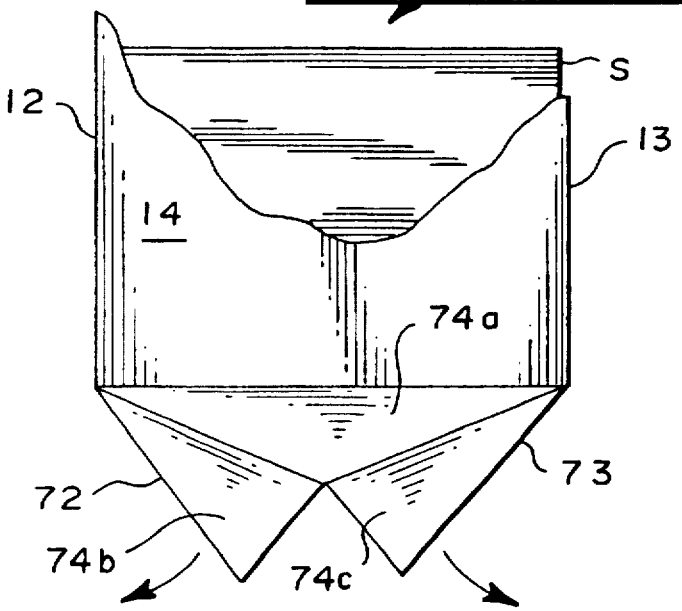
Figure 24:
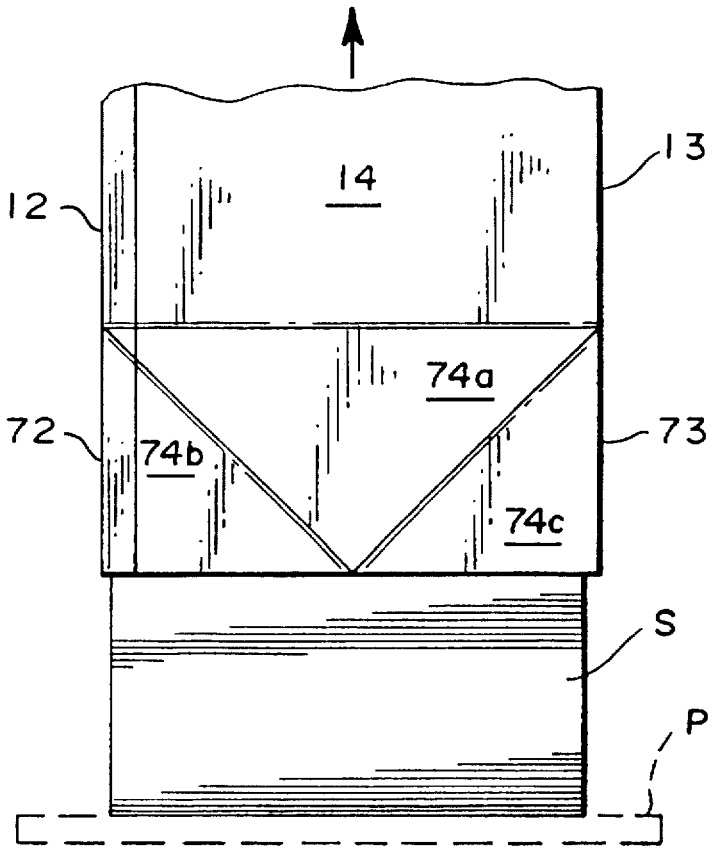
Figure 26:
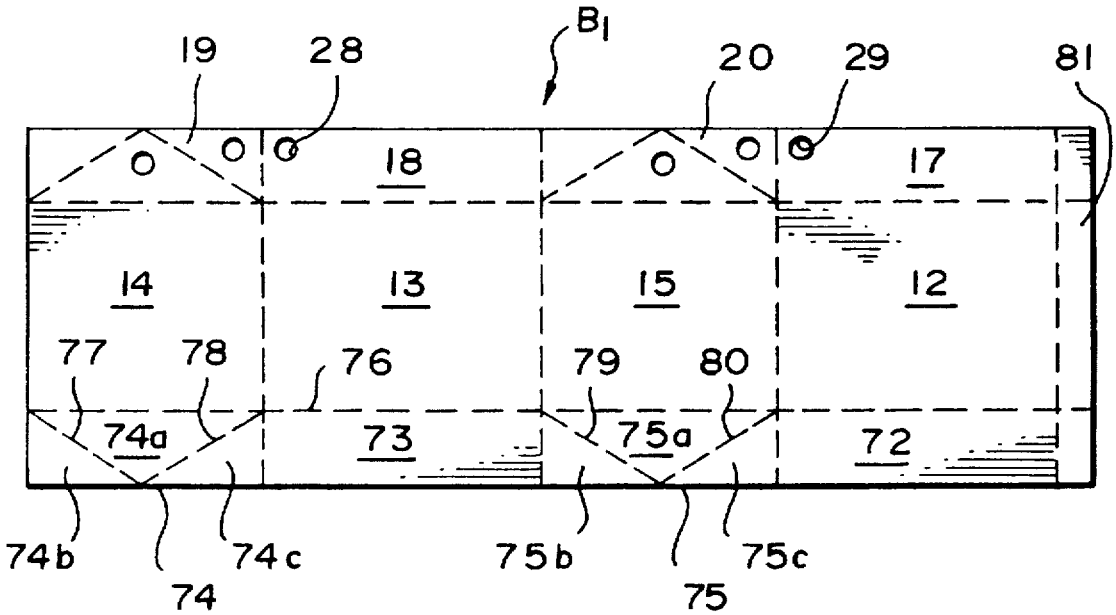
FIG. 26 is a plan view of the blank used in forming the box of that form of the invention illustrated in FIGS. 19–25.
Figure 25:
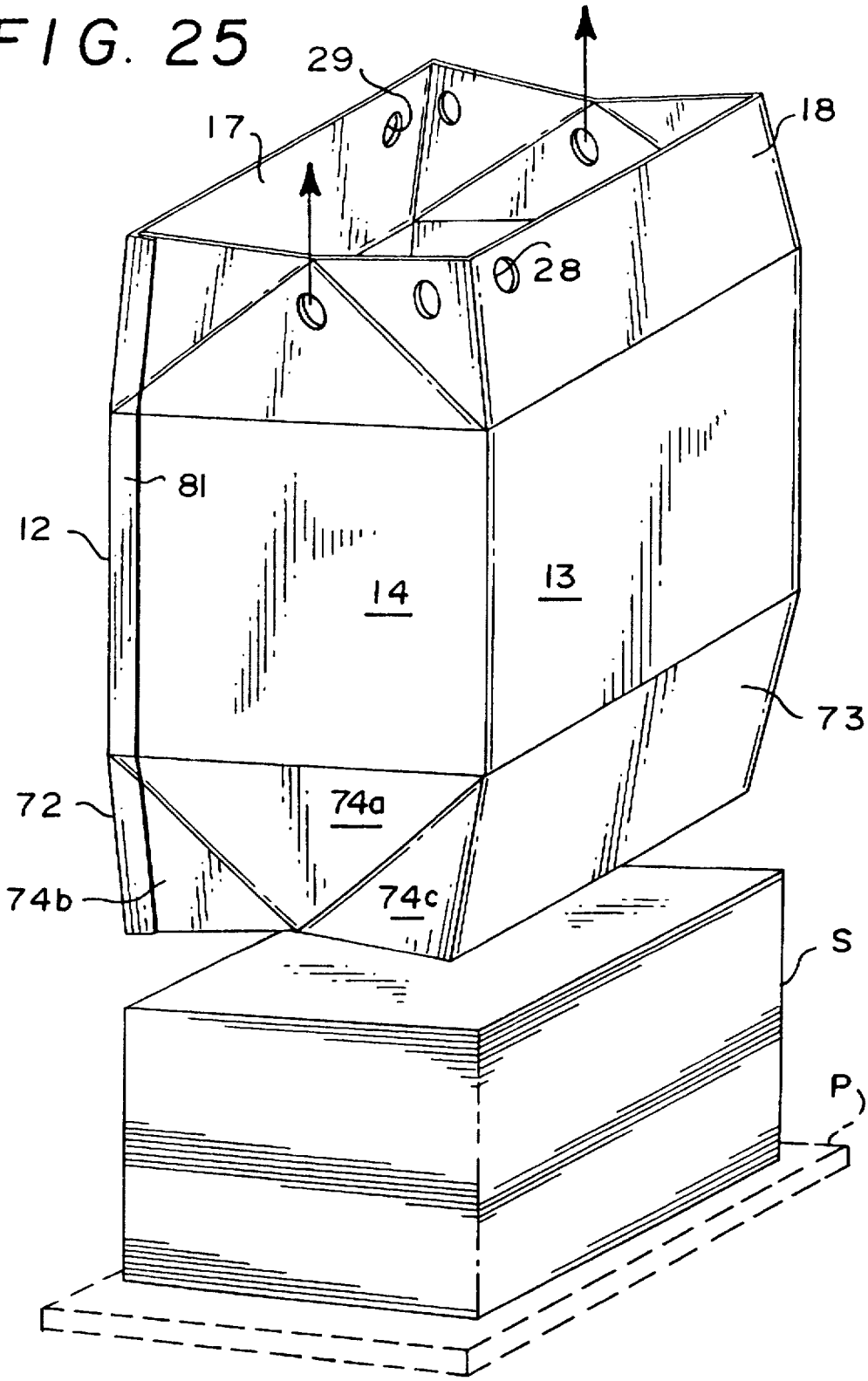

Thus, when the box is lifted from the stack of paper in the manner as described in relation to that from of the invention illustrated in FIGS. 1–9, the bottom panel 51 remains in place beneath the stack of paper "S" after the paper has been deposited onto the platform "P" in the supply bin of the photocopier or other machine, and the tab 52 is exposed at one side, whereby it may be grasped and pulled to remove the panel 51 from beneath the stack of paper, as depicted in FIGS. 13 and 14.

It should be noted that the provision of the bottom panel 51 eliminates the necessity of utilizing shrink wrap as is done in the previously described form of the invention, if a moisture vapor barrier material is incorporated in the walls of the box itself, including the panel 51. Further, one or more support straps 40, 41 may be placed in encircling relationship to the box, either in a lateral or longitudinal direction, or both, to maintain the box closed until it is desired to dispense the paper therefrom.

Second Modification

A second modification of the invention is indicated generally at 60 in FIGS. 15–18. This form of the invention is substantially identical to that described in relation to FIGS. 10–14, and includes a bottom panel 61 which fits closely within the side walls of the box 11 and lies on top of the bottom wall flanges 35–38. However, unlike the previously described form of the invention, there is no pull tab on the bottom wall panel 61. Instead, after the box 11 has been removed from the stack of the paper "S" to deposit the paper onto the platform "P" of the supply bin of a photocopier or other machine, the bottom panel 61 simply remains in place beneath the stack of paper.

In all other respects, this form of the invention is identical to that described immediately above.

Third Modification

A third modification of the invention is indicated generally at 70 in FIGS. 19–26. This form of the invention functions similarly to the previously described forms of the invention, but differs essentially in that the bottom wall 71 completely closes the bottom end of the box and is defined by a bellows-folded set of flaps substantially identical to those used in forming the top wall 16. Thus, a pair of bottom wall side panels or flaps 72 and 73 are formed at the bottom edges of side walls 12 and 13, substantially identical in size and shape to the top wall flaps or panels 17 and 18, respectively, except that the openings 28 and 29 that appear in the top wall panels are omitted in the bottom wall panels. Similarly, bottom end wall panels or flaps 74 and 75 are formed at the bottom edges of end walls 14 and 15, respectively, substantially identical in size and shape to the top wall panels or flaps 19 and 20 at the tops of the end wall panels, respectively, except that the openings 30–31 and 32–33 that appear in the top end wall panels are omitted from the bottom end wall panels.

Flap 74 includes a first triangularly shaped panel **74*a* at the center of the flap and second and third triangularly shaped panels 74*b* and 74*c*, respectively, on opposite sides of the center panel. The center panel has its base edge joined to the end panel 14 along fold line 76, and the side panels are joined to the center panel along diagonal fold lines 77 and 78**, respectively.

Similarly, bottom end flap 75 comprises a center triangularly shaped panel **75*a* with its relatively wide base end lying on the fold line 76, and a pair of triangularly shaped side panels 75*b* and 75*c* joined to the center panel along diagonal fold lines 79 and 80**.

Further, a vertically extending glue tab 81 is formed along one end edge of the blank B1, at the free edges of side panel 12 and top and bottom side panels 17 and 72.

With reference to FIGS. 20–25, the bottom wall 71 is folded similarly to the way in which the top wall 16 is folded, whereby the opposite bottom side wall flaps 72 and 73 are folded over the bellows-folded end panels 74 and 75, with the free edges of panels 72 and 73 lying in contiguous relationship to one another when in the fully closed position, and with the triangularly shaped panels **74*a* and 75*a* disposed internally of the bottom of the box. Thus, when the support straps are removed, the weight of the paper acts primarily upon panels 74*a* and 75*a* to move those panels downwardly and outwardly relative to the bottom of the box, causing the side panels 72 and 73** to also unfold as the box is lifted, so that the weight of the paper will cause the bottom wall to unfold and open up to discharge the paper onto the platform "P" of the photocopier or the like.

As with those forms of the invention described above which utilize a bottom panel in the box, this form of the invention does not require the use of shrink wrap, but a moisture vapor barrier material may be incorporated into the box itself to provide protection to the paper from ambient conditions. Of course, shrink wrap could be used instead, if desired.

It will be seen from the above that the present invention provides a very simple and economical package for shipping, storing and dispensing cut paper into the supply bin of a photocopier or printer or other machine. Further, the use of a single glue seam in the manufacture of the box greatly simplifies the manufacturing process and contributes to the ease of recycling.

While particular embodiments of the invention have been illustrated and described in detail herein, it should be understood that various changes and modifications may be made to the invention without departing from the spirit and intent of the invention as defined by the scope of the appended claims.

What is claimed is:

1. A bin loader package for shipping, storing and dispensing cut paper directly into the paper supply bin of a photocopier, printer or other equipment having means for storing a supply of paper used in operation of the equipment, comprising;

means defining a box having opposite side walls, opposite end walls, a top wall and a bottom;

said bottom having wall means movable between an open position and a closed position, said wall means, when in closed position, supporting at least a marginal edge portion of sheets of paper placed in the box;

said wall means being openable under the weight of paper in the box when the box is lifted to open the bottom of the box and enable the paper to drop through the open bottom for deposit onto a supporting surface in the paper supply bin, thereby enabling the paper to be quickly and easily deposited directly from the box into the bin; and said top wall has lifting means to facilitate grasping of the top wall to lift the box for discharge of paper through the bottom.

2. A bin loader package as claimed in claim 1, wherein:

support means is provided in association with the box to maintain the box closed and to prevent discharge of paper therefrom until ready for use, said support means being removable to enable the bottom of the box to open under the influence of the weight of paper in the box when the box is lifted.

3. A bin loader package as claimed in claim 1, wherein:

means is provided in association with the box to protect the paper and to maintain a predetermined moisture content thereof.

4. A bin loader package as claimed in claim 1, wherein:

said means defining a box comprises a folded blank made from a material selected from the group consisting of corrugated cardboard, paperboard, and plastic.

5. A bin loader package as claimed in claim 2, wherein:

the bottom wall means that is movable between open and closed positions comprises foldable flaps integrally joined via fold lines to a bottom edge of each of the side and end walls.

6. A bin loader package as claimed in claim 5, wherein:

the support means comprises at least one strap disposed around the box to maintain the flaps closed until ready for use.

7. A bin loader package as claimed in claim 6, wherein:

the foldable flaps are relatively narrow and when folded to their closed position are spaced from one another, leaving an opening through the bottom of the box.

8. A bin loader package as claimed in claim 7, wherein:

a shrink wrap is applied to the box to provide a moisture vapor barrier for maintaining proper moisture barrier content in paper stored in the box.

9. A bin loader package as claimed in claim 5, wherein:

the foldable flaps are dimensioned to close the bottom of the box when they are folded to their closed position.

10. A bin loader package as claimed in claim 9, wherein:

a moisture vapor barrier material is incorporated in the walls and bottom of the box to maintain a predetermined moisture content of paper stored in the box.

11. A bin loader package as claimed in claim 3, wherein:

a shrink wrap is applied to the box to provide a moisture vapor barrier for maintaining a predetermined moisture barrier content in paper stored in the box.

12. A bin loader package as claimed in claim 1, wherein:

the top wall comprises a foldable top flap on an upper edge of each of the side and end walls, said top flaps being foldable inwardly over the top of the box to close the top of the box.

13. A bin loader package as claimed in claim 12, wherein:

the foldable top flaps include a bellows-folded top end wall flap on each of the end walls, defined by a plurality of triangularly shaped panels joined at diagonally extending fold lines; and said lifting means comprises at least one opening formed through at least one panel in each of the opposed top end wall flaps, whereby the fingers may be inserted through the openings to lift the box.

14. A bin loader package as claimed in claim 13, wherein:

the bottom wall means that is movable between open and closed positions comprises a foldable bottom flap on a bottom edge of each of the opposite side and end walls, said bottom flaps being foldable inwardly over the bottom of the box to at least partially close the bottom of the box.

15. A bin loader package as claimed in claim 14, wherein:

the bottom flaps are relatively narrow and when folded to their closed position are spaced from one another, leaving an opening through the bottom of the box.

16. A bin loader package as claimed in claim 14, wherein:

the bottom flaps are dimensioned to close the bottom of the box when they are folded to their closed position.

17. A blank for forming a package containing a quantity of sheets of paper, in which the package has .bottom that is openable under the weight of paper in the package so that the paper can be discharged through the bottom of the package as it is lifted, said blank comprising:

a plurality of wall panels joined together at spaced apart, parallel, transverse fold lines for forming side and end walls when the blank is folded to its operative position to form the package;

a plurality of flap panels integrally joined to the wall panels via a longitudinal fold line extending along one edge of the wall panels, said flap panels being joined to one another at adjacent edges via said transverse fold lines, and forming opposed top end wall flaps and opposed top side wall flaps when the blank is folded to its operative position to form the package; and at least one of said flap panels having lifting means formed thereon to facilitate grasping of the flap and lifting of the package when the panels are folded to their operative position to form the package.

18. A bin loader package containing a quantity of sheets of paper for shipping, storing and dispensing the paper directly into the paper supply bin of a photocopier, printer or other equipment having means for storing a supply of paper used in operation of the equipment, comprising;

means defining a box having opposite side walls, opposite end walls, a top and a bottom;

said bottom having wall means movable between an open position and a closed position, said wall means comprising narrow foldable flaps integrally joined via fold lines to a bottom edge of each of the side and end walls, defining a narrow ledge around the open bottom of the box when the flaps are in their closed position, whereby only a narrow marginal edge portion of a stack of paper in the box is engaged and supported by the flaps when they are closed, said flaps being easily openable under the weight of paper in the box when the box is lifted, to open the bottom of the box and enable the paper to drop only a very short distance through the open bottom for deposit directly from the box onto a supporting surface in the paper supply bin.

19. A bin loader package as claimed in claim 18, wherein:

support means is provided in association with the box to maintain the box closed and to prevent discharge of paper therefrom until ready for use, said support means being removable to enable the bottom of the box to open under the influence of the weight of paper in the box when the box is lifted.

20. A bin loader package as claimed in claim 18, wherein:

means is provided in association with the box to protect the paper and to maintain the proper moisture content thereof.

21. A bin loader package as claimed in claim 18, wherein:

said means defining a box comprises a folded blank made from a material selected from the group consisting of corrugated cardboard, paperboard, and plastic.

22. A bin loader package as claimed in claim in claim 18, wherein:

an insert panel is provided in said box, supported on the narrow foldable flaps to fully close the bottom of the box.

23. A bin loader package as claimed in claim 22, wherein:

an outwardly projecting tab is on an edge of said insert panel to provide a means for grasping the panel to slide it from beneath a stack of paper that has been deposited from the box into the paper supply bin of a photcopier, printer or other equipment.

24. A bin loader package as claimed in claim 22, wherein:

a moisture vapor barrier material is incorporated in the walls of the box and in the insert panel to maintain a predetermined moisture content of paper within the box.

25. A bin loader package as claimed in claim 24, wherein:

the moisture vapor barrier material comprises a repulpable coating.

26. A bin loader package for shipping, storing and dispensing cut paper directly into the paper supply bin of a photocopier, printer or other equipment having means for storing a supply of paper used in operation of the equipment, comprising;

means defining a box having opposite side walls, opposite end walls, a top wall and a bottom wall;

said top wall has lifting means to facilitate grasping of the top wall to lift the box for discharge of paper through the bottom of the box;

said bottom wall including flap means movable between an open position and a closed position, said flap means, when in closed position, supporting at least a marginal edge portion of sheets of paper placed in the box, and being openable under the weight of paper in the box when the box is lifted to open the bottom of the box and enable the paper to drop through the open bottom for deposit onto a supporting surface in the paper supply bin, thereby enabling the paper to be quickly and easily deposited directly from the box into the bin; and a moisture vapor barrier material incorporated in the walls of the box to maintain a predetermined moisture content of paper stored in the box.

27. A bin loader package as claimed in claim 26, wherein:

the flap means are integrally joined via fold lines to a bottom edge of each of the side and end walls.

28. A bin loader package as claimed in claim 27, wherein:

the support means comprises at least one strap disposed around the box to maintain the flaps closed until ready for use.

29. A bin loader package as claimed in claim 27, wherein:

the foldable flaps are relatively narrow and when folded to their closed position are spaced from one another, leaving an opening through the bottom of the box.

30. A bin loader package as claimed in claim 27, wherein:

the foldable flaps are dimensioned to close the bottom of the box when they are folded to their closed position.

31. A bin loader package containing a quantity of sheets of paper for shipping, storing and dispensing the paper directly into the paper supply bin of a photocopier, printer or other equipment having means for storing a supply of paper used in operation of the equipment, comprising;

means defining a box having opposite side walls, opposite end walls, a top and bottom;

said bottom comprising foldable flaps integrally joined via fold lines to a bottom edge of each of the side and end walls and movable between an open position and a closed position and when in closed position supporting at least a marginal edge portion of sheets of paper placed in the box, said flaps being openable under the weight of paper in the box when the box is lifted to open the bottom of the box and enable the paper to drop through the open bottom for deposit onto a supporting surface in the paper supply bin, thereby enabling the paper to be quickly and easily deposited directly from the box into the bin;

said flaps including a pair of rectangular bottom wall side flaps joined at a fold line to a bottom edge of respective opposite side walls of the box and having free edges extending into contiguous relationship with one another when folded into closed position across the bottom of the box, and a pair of bottom wall end flaps joined at a fold line to the bottom edges of respective opposite end walls of the box, said bottom end flaps each divided by a pair of diagonal fold lines into a central triangularly shaped panel having a base edge coincident with the fold line joining the bottom end flap to a respective box end wall, and a pair of outer triangular panels joined along fold lines to respective adjacent end edges of said rectangular bottom wall side flaps, said central triangular panels first being folded inwardly over the bottom of the box, with the outer triangular panels lying against the central triangular panel and the opposite bottom wall side flaps lying over the triangular panels of the inwardly folded bottom wall end flaps, whereby the weight of paper held within the box rests primarily on the first-folded center triangular panels of the bottom wall end flaps to move these panels downwardly and outwardly relative to the bottom of the box, causing the opposite outer triangular panels and the side flaps to also untold as the box is lifted to discharge the paper onto a platform of the photocopier or the like.

32. A bin loader package as claimed in claim 31, wherein:

a moisture vapor barrier material is incorporated in the walls and bottom of the box to maintain a predetermined moisture content of paper stored in the box.

* * * * *